US007273148B2

(12) United States Patent
Perry et al.

(10) Patent No.: US 7,273,148 B2
(45) Date of Patent: Sep. 25, 2007

(54) TOOL HOLDER AND METHOD OF USE

(76) Inventors: Martha Starr Perry, 10 Ski Haven P.O. Box 610, Justin, TX (US) 76247; Michael Stuart Perry, 10 Ski Haven P.O. Box 610, Justin, TX (US) 76247

( * ) Notice: Subject to any disclaimer, the term of this patent is extended or adjusted under 35 U.S.C. 154(b) by 51 days.

(21) Appl. No.: 11/146,691

(22) Filed: Jun. 7, 2005

(65) Prior Publication Data

US 2005/0224392 A1 Oct. 13, 2005

Related U.S. Application Data

(63) Continuation-in-part of application No. 10/274,334, filed on Oct. 18, 2002, now Pat. No. 6,926,151.

(60) Provisional application No. 60/394,617, filed on Jul. 9, 2002.

(51) Int. Cl.
*B65D 85/20* (2006.01)

(52) U.S. Cl. ..... 206/750; 206/214; 206/362; 206/371; 206/373; 206/752; 383/39; 493/210

(58) Field of Classification Search ..... 206/1.7–1.9, 206/45.2, 45.21, 45.28, 45.29, 362, 443, 206/371–379, 581, 214, 349, 361, 362.1, 206/362.4, 363, 760, 747–752; 383/39; 493/210, 493/214, 223, 239, 227–229
See application file for complete search history.

(56) References Cited

U.S. PATENT DOCUMENTS 1,085,950 A 2/1914 Steinthal
1,094,009 A * 4/1914 Parkhurst ..... 206/373
1,128,542 A 2/1915 Steinthal
1,434,350 A 10/1922 Collins
2,679,877 A 6/1954 Leggett
2,801,739 A * 8/1957 Christensen ..... 206/750
2,809,766 A * 10/1957 Anderson ..... 220/326
3,749,233 A 7/1973 McCormick, Jr.
3,769,741 A * 11/1973 Hessler et al. ..... 206/750
4,101,025 A 7/1978 Jordan
4,210,244 A 7/1980 Westrick
4,478,333 A 10/1984 Dalbo et al.
4,691,469 A * 9/1987 Alsobrook et al. .... 206/315.11
4,715,499 A 12/1987 Franklin
4,738,547 A 4/1988 Brown
4,901,899 A 2/1990 Barrett
4,949,843 A 8/1990 Stokes
5,002,401 A 3/1991 Blackman
5,009,346 A * 4/1991 Butler ..... 206/315.11
5,020,673 A 6/1991 Adams
5,139,143 A 8/1992 Pond (Continued)

*Primary Examiner*—Luan K Bui
(74) *Attorney, Agent, or Firm*—Schultz & Associates, P.C.

(57) ABSTRACT

The present invention is directed to a tool holder convertible between storage and display configurations and a method of manufacture therefore. In one embodiment, the tool holder includes a flexible wrapper including first and second parallel major and minor edges and a fold line located between the first and second major edges. The tool holder also includes a first fastener including first and second portions located proximate the first and second minor edges, respectfully, that is alignable in opposition to allow a coupling of the first and second minor edges.

17 Claims, 12 Drawing Sheets

U.S. PATENT DOCUMENTS 5,174,447 A * 12/1992 Fleming ..... 206/373
5,427,239 A 6/1995 Hunt
5,984,092 A 11/1999 Heard-Willmon
6,109,442 A 8/2000 Roegner
6,244,485 B1 6/2001 Holland et al.
6,244,486 B1 6/2001 Holland et al.
6,398,027 B1 6/2002 Ryu

* cited by examiner

TOOL HOLDER AND METHOD OF USE

CROSS REFERENCE TO RELATED APPLICATION

The present application is a continuation-in-part of U.S. patent application Ser. No. 10/274,334 now U.S. Pat No. 6,926,151, entitled "Tool Holder and Method of Manufacture Therefor," filed Oct. 18, 2002, which claims priority to Provisional Application Ser. No. 60/394,617, entitled "Convertible Pouch", to Perry, et al, filed Jul. 9, 2002.

FIELD OF THE INVENTION

The present invention is directed in general, to a tool holder configuration and, more specifically, to a tool holder convertible between storage and display configurations and a method of manufacture thereof.

BACKGROUND OF THE INVENTION

Technicians are constantly confronted with the need to store and protect the tools of their trade. To protect their investments from damage and loss while simultaneously trying to keep them clean and readily available, various types of tool kits and tool holders have been developed. Traditionally, tools have been kept in a conventional tool box. A conventional tool box, however, does not prevent abrasion between the tools and the box interior or other tools in the box and, as such, can scratch or break the tools and does not contribute toward keeping the tools clean and in good condition. A conventional tool box for delicate tools (e.g. brushes) is undesirable.

To improve protection for the tools and to keep them in an organized fashion, various roll-up tool bags have also been designed. A conventional, roll-up tool bag includes a plurality of pockets with each pocket designed to receive an individual tool. The roll-up tool bag is typically made of a soft, flexible material that enables the bag containing the tools to be rolled up for convenient, compact storage or transportation when the tools are not in use. Securing the tool bag in its rolled-up configuration is usually accomplished with circumferential straps or ties, thereby allowing for varying thickness of the bag because of a varying number of tools therein. The thickness of the rolled-up tool bag is dictated by the tools contained therein and the length/number of pockets of the tool bag.

Although roll-up tool bags help to prevent direct contact between the tools and aid in keeping the tools clean, a major drawback to conventional tool bags has been encountered. Tool accessibility is generally accomplished with a conventional, roll-up tool bag unrolled and laid flat upon a horizontal surface, thereby occupying a significant amount of work space. Alternatively, the tool bag may be attached to some vertical surface with hanging hooks, magnets or the like if a suitable surface is available. However, in some trades, it would be desirable to have the tools at least partially displayed in a vertical fashion to facilitate selection of a desired tool. One trade is cosmetology, wherein a cosmetologist could benefit by more quickly selecting a desired applicator, typically a brush, if all of the available applicators were vertically displayed in a holder that takes up less work surface. Additionally, the cosmetologist is usually confronted with limited work space upon which to place their tools.

Accordingly, what is needed in the art is a flexible, roll-up tool holder that protects the tools when closed, and enables conversion to a display configuration that takes up less work space while conveniently presenting the tools for easy access.

SUMMARY OF THE INVENTION

To address the above-discussed deficiencies of the prior art, the present invention provides a tool holder including a flexible wrapper and a first fastener. In one embodiment, the flexible wrapper includes first and second parallel major and minor edges and a fold line located between the first and second major edges. In one embodiment, the first minor edge includes a first notch proximate a corner thereof. In another embodiment, the notch is not present. The first fastener includes a first and second portion located proximate the first and second minor edges, respectively, that are alignable in opposition to allow a coupling of the first and second minor edges.

The tool holder of the present invention is convertible between a storage and display configuration. The tool holder, therefore, provides dual functionality in a compact and conveniently deployed package. The tool holder is employable in many applications including the field of cosmetology wherein flexibility in tool storage and presentation is very beneficial.

In another aspect, the present invention provides a method of manufacturing a tool holder. The method includes providing a flexible wrapper including first and second parallel major and minor edges, and forming a fold line between the first and second major edges (but does not necessarily require this step). The method may include forming a first notch proximate a corner of the first minor edge. The method still further includes locating a first portion of a first fastener proximate the first minor edge, and locating a second portion of the first fastener proximate the second minor edge.

The foregoing outlines preferred and alternate features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purpose of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following description taken in conjunction with the accompanying drawings, in which.

DETAILED DESCRIPTION

Figure 1:
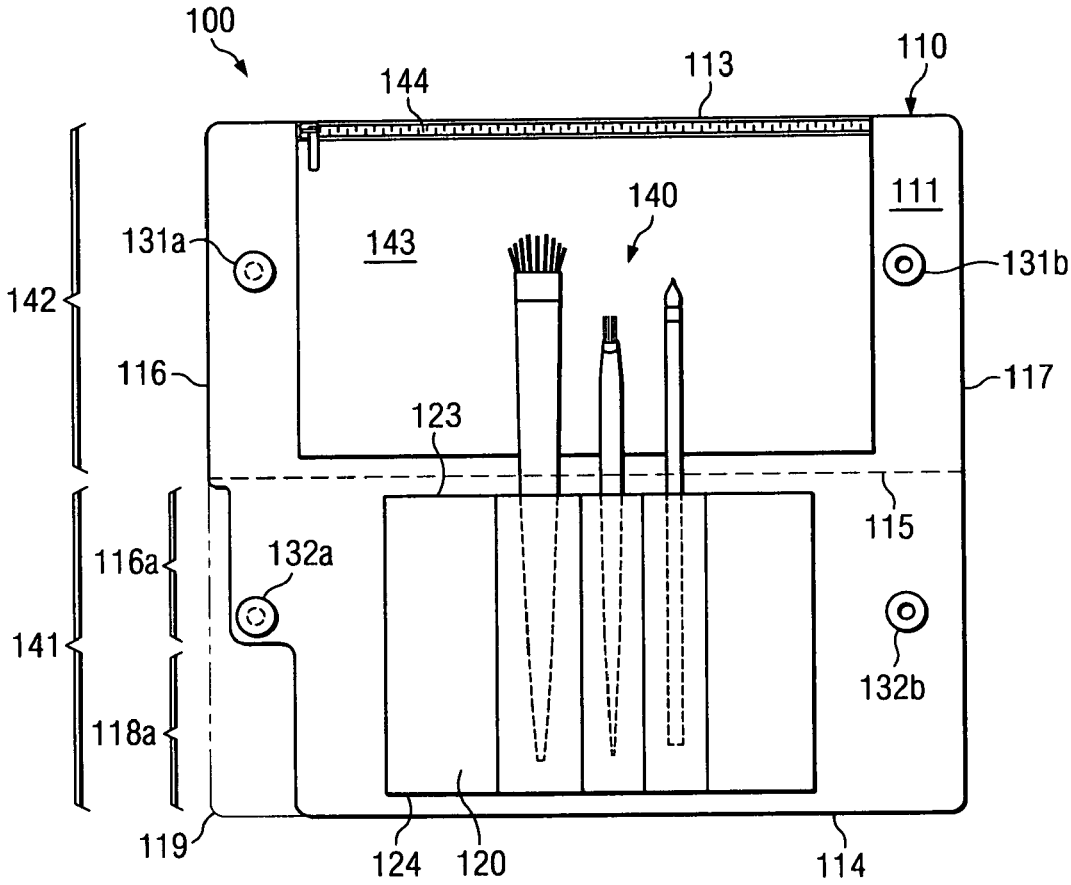
FIG. 1 illustrates a plan view of one embodiment of a tool holder constructed according to the principles of the present invention.

Referring initially to FIG. 1, illustrated is a plan view of one embodiment of tool holder 100 constructed according to the principles of the present invention. Tool holder 100 includes flexible wrapper 110, pocket or plurality of pockets (one of which is designated 120), and first and second fasteners. While two fasteners are illustrated, fewer than two or no fasteners may be used. Flexible wrapper 110 comprises inner face 111 and outer face (see FIG. 2). Tool holder 100 is shown in FIG. 1 as it would appear laid open upon a horizontal surface.

Flexible wrapper 110 is constructed of a sheet-like material, e.g., leather, vinyl, cloth, plastic, nylon etc., and is preferably substantially rectangular in shape (although other shapes are well within the broad scope of the invention). Flexible wrapper 110 has first and second parallel major edges 113 and 114, first and second parallel minor edges 116 and 117, and a fold line (e.g. a centerline) 115 between the first and second major edges 113 and 114. While fold line 115 is illustrated and hereinafter described as a centerline between first and second major edges 113 and 114, those skilled in the art understand that it is not necessary to locate fold line 115 equidistance between first and second major edges 113 and 114. It should also be understood that for the purposes of discussion that the terms fold line and centerline may be used interchangeably. First minor edge 116 has first notch 118*a* therein proximate a corner 119 thereof. First minor edge 116 also has indention 116*a* formed therein from about first notch 118*a* to about fold line 115. For the purpose of this discussion, an indention is a portion of an edge that has been cut away to form an indented edge.

First and second fasteners include first portions 131*a* and 132*a* and second portions 131*b* and 132*b*, respectfully. First portions 131*a* and 132*b* of first and second fasteners are spaced apart and coupled to flexible wrapper 110 proximate first minor edge 116. Second portions 131*b* and 132*b* of first and second fastener are spaced apart and coupled to flexible wrapper 110 proximate second minor edge 117. In a preferred embodiment, first portions 131*a* and 132*a* are male (stud) portions of a conventional snap fastener wherein the stud portion extends from the outer face (see FIG. 2). The back side of first portions 131*a* and 132*b* are shown in FIG. 1. Similarly, second portions 131*b* and 132*b* includes female (receiving) portions of the snap fasteners with the receiving portion accessible on inner face 111 of flexible wrapper 110.

In an alternate embodiment, first portions 131*a* and 132*a* may be hook portions of a Velcro fastener and second portions 131*b*, 132*b* and 133*b* may be pile portions of the Velcro fastener. Of course, the hook and pile portions may be interchanged while remaining within the scope of the present invention. Similarly, other types of fasteners, e.g. magnetic, clasps, buttons and button holes, ties, etc. may also be used. Those skilled in the art are familiar with the conventional methods used to couple or mount such fasteners to flexible wrapper 110. In the embodiment where no fastener is required, the flexible wrapper can also include a spring loaded hinge. This hinge is located inside the flexible wrapper and is biased to hold the flexible wrapper in an open or closed configuration. When flexible wrapper 110 is rolled up in a storage configuration, first portions 131*a* and 132*a* and second portions 131*b* and 132*b* are configured to couple first and second minor edges 116 and 117 together, wherein second minor edge 117 overlaps first minor edge 116, thereby hiding indention 116*a* and first notch 118*a*.

Pockets 120 are affixed to inner face 111 by sewing or with a suitable adhesive. In a preferred embodiment, pockets 120 may include a flexible, sheet-like material compatible with the sheet-like material of flexible wrapper 110. Of course, other materials including a flexible mesh or transparent flexible material may also be used. Even a flexible, stretchable material may be used. Pockets 120 are affixed to inner face 111 of flexible wrapper 110 by conventional means such as sewing, adhesive, etc. Those skilled in the art are familiar with methods of affixing one piece of flexible material to another piece of flexible material, whether they are similar or dissimilar.

The number and size of pockets 120 is dictated by type and number of tools desired to be stored or displayed. Pockets 120 have open ends (one of which is designated 123) aligned proximate fold line 115 and closed ends (one of which is designated 124) aligned proximate second major edge 114. For illustrative purposes, a variety of tools (one of which is designated 140) are shown in conjunction with tool holder 100. Open ends 123 of pockets 120 are configured to each receive at least a portion of each of tools 140. In a preferred embodiment, pockets 120 may number five in order to form a convenient size for tool holder 100 when rolled for storage or formed as a display. However, those skilled in the art will realize that the number of pockets 120 may vary above or below five as required.

Tools 140 may be virtually any tool, e.g. a screwdriver, a nutdriver, a wrench, a brush, a pliers, a scraper, a knife, a pen, a pencil, a scalpel, etc. Of course, there may be more than one of a particular type of tool, e.g., a variety of screwdrivers, etc. In one embodiment, tools 140 are a variety of cosmetic brushes, artist's brushes and writing tools. In a preferred embodiment, tool holder 100 is a cosmetologist's tool holder holding tools such as a brush, lipstick, eyeliner, a mascara pencil, or a spatula. Of course, the exact tools will be dictated by the needs of the user. In another embodiment, the tool holder 100 is an artist's tool holder holding tools such as brushes, drawing pencils, charcoal sticks, etc. Those skilled in the art will recognize that both cosmetologists and artists use a variety of brushes and other tools to accomplish their respective arts.

Fold line 115 of tool holder 100 defines a first section 141 and a second section 142 of flexible wrapper 110. In the illustrated embodiment, first section 141 accommodates pockets 120 affixed to inner face 111. Second section 142 accommodates a purse 143 affixed to inner face 111 of second section 142. Purse 143 has closure 144 along at least a portion of first major edge 113. Purse 143 may be used to hold smaller objects or tools that are not suitable for storage in pockets 120. Closure 144 may be a zipper, plastic zip seal, matching Velcro portions or similar closures.

Figure 2:
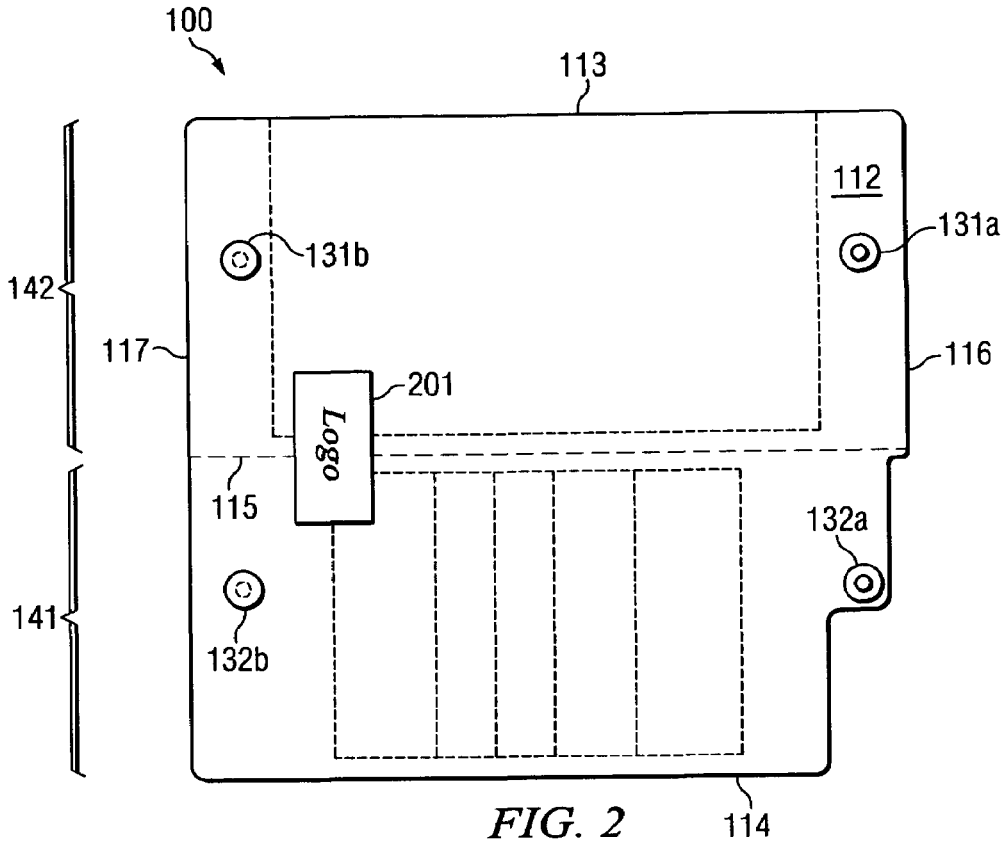
FIG. 2 illustrates a plan view of an outer face of the tool holder of FIG. 1.

Referring now to FIG. 2, illustrated is a plan view of outer face 112 of tool holder 100 of FIG. 1. Shown are the covers of second (e.g. female) portions 131*b* and 132*b* and first (e.g. male or stud) portions 131*a* and 132*b* and the first and second fasteners, respectively. Flexible wrapper 110 may further include logotype 201 to identify, for example, a manufacturer of tool holder 100 or the tools contained therein. Second portions 131*b* and 132*b* and their respective first portions 131*a* and 132*b* are spaced apart along their respective minor edges 116 and 117 by substantially the same distances to further facilitate a coupling of the first and second minor edges 116 and 117 when overlapped. Fold line 115 divides first section 141 from second section 142. Fold line 115 allows outer surface 112 of first section 141 to be folded over to contact outer surface 112 of second section 142.

Figure 3:
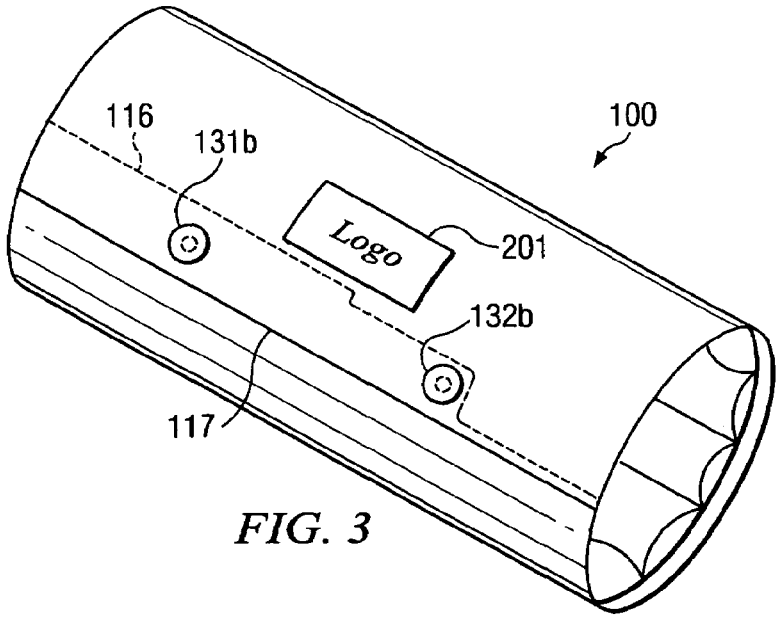
FIG. 3 illustrates an isometric view of the tool holder of FIG. 1 in a rolled, storage configuration.

Referring now to FIG. 3, illustrated is an isometric view of tool holder 100 of FIG. 1 in a rolled, storage configuration. Shown are the covers of second portion 131*b* and 132*b* of the first and second fasteners that couple first and second minor edges 116 and 117 together when overlapped. Logotype 201 is visible in this configuration.

Figure 4:
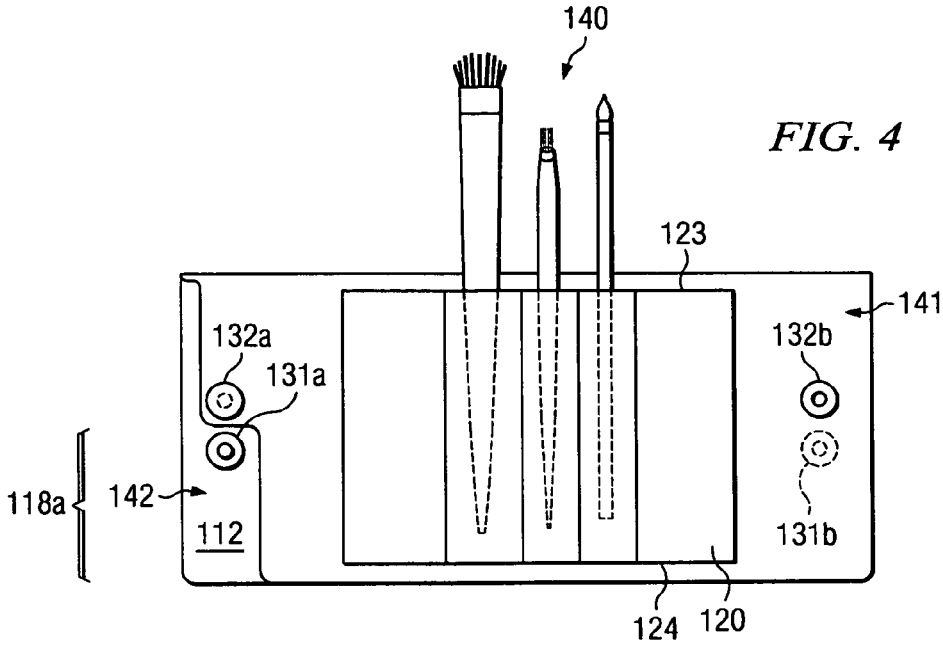
FIG. 4 illustrates a plan view of the tool holder of FIG. 1 with the outer face of a second section thereof folded over and in contact with the outer face of a first section thereof.

Referring now to FIG. 4, illustrated is a plan view of tool holder 100 of FIG. 1 with outer face 112 of second section 142 folded over and in contact with outer face 112 of the first section 141. First portion 131*a* of the first fastener is shown to be in alignment with first notch 118*a*. Pockets 120 with an open end 123 and closed end 124 are clearly visible. Second portion 131*b* of the first fastener is shown in phantom and aligned to couple to first portion 131*a* when tool holder 100 is rolled to couple first and second minor edges 116 and 117 together is an overlapped configuration. In the preferred embodiment shown, tools 140 are shown as they would appear having been inserted into open end 123 of pockets 120.

Figure 5:
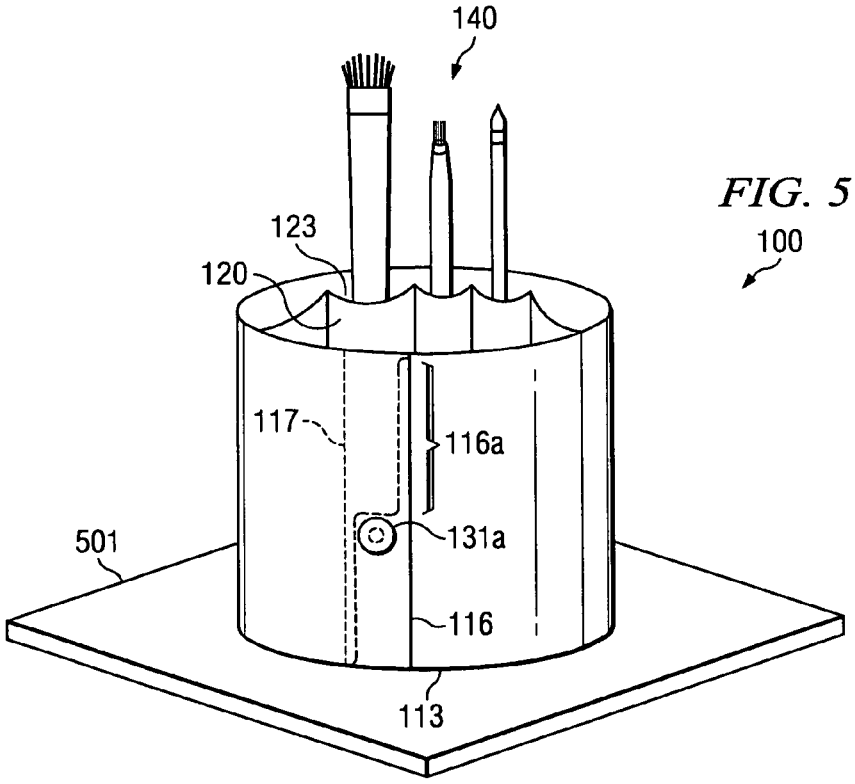
FIG. 5 illustrates an isometric view of the tool holder of FIG. 1 in a free-standing, substantially circular display configuration.

Referring now to FIG. 5, illustrated is an isometric view of folded tool holder 100 of FIG. 1 in a free-standing, substantially circular display configuration. First major edge 113 is shown free standing upon surface 501. It can be readily seen that the free-standing display of FIG. 5 consumes a significantly smaller amount of space as a free-standing, substantially circular display stand than the unrolled holder displayed in FIG. 1. The back side of first portion 131*a* of the first fastener is shown as it couples first and second minor edges 116 and 117 together in an overlapped configuration. Indention 116*a* is configured so that first minor edge 116 in the area does not protrude from under the folder-over first minor edge 116 when tool holder 100 is in this configuration.

In another embodiment, not shown, the freestanding display configuration is oriented so that pockets 123 are on the external surface of the freestanding display. Fastener 131 is used to couple first and second minor edges 116 and 117 in an overlapped configuration.

Furthermore, first notch 118*a* allows first and second portions 131*a* and 131*b* of the first fastener to align in opposition for coupling. Shown are tools 140 as they would appear extending from open end 123 of pockets 120. Those skilled in the art will readily understand the convenience that the present invention provides by being a free-standing holder of tools, e.g., cosmetic brushes that extend from and are clearly visible as to size or type when compared to a conventional tool holder that must lie flat upon a work surface.

Figure 6:
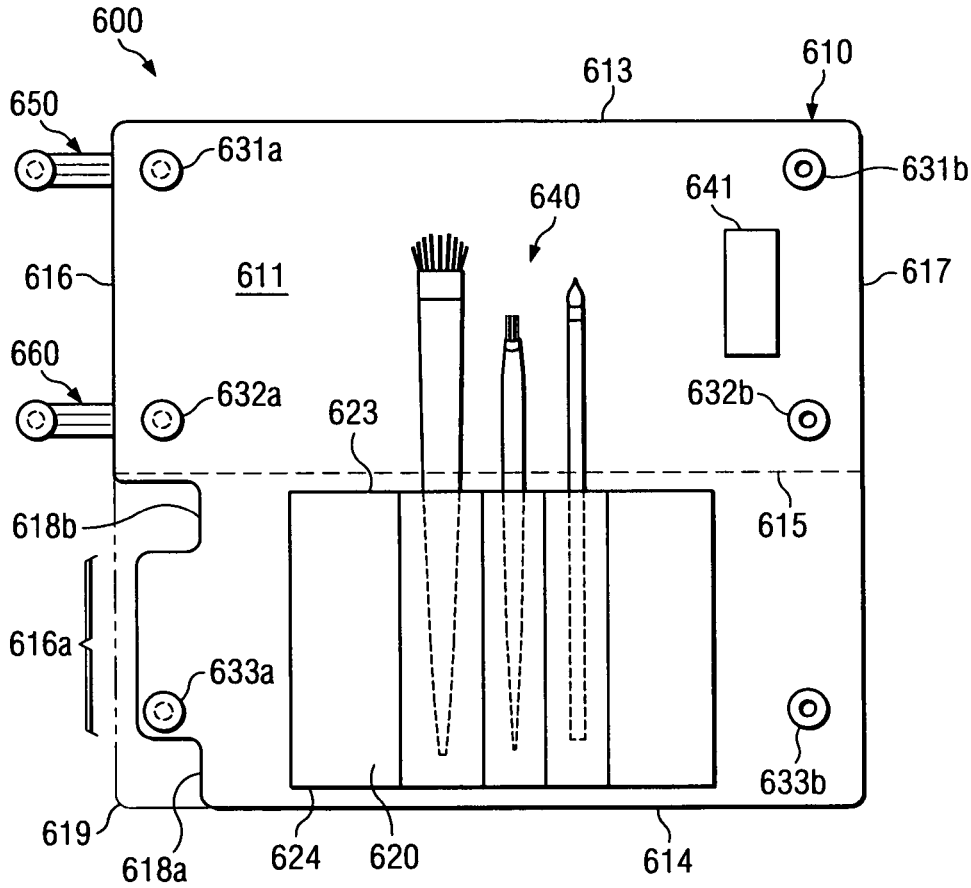
FIG. 6 illustrates a plan view of an alternate embodiment of a tool holder constructed according to the principles of the present invention.

Referring now to FIG. 6, illustrated is a plan view of an alternate embodiment of tool holder 600 constructed according to the principles of the present invention. Tool holder 600 includes flexible wrapper 610, pocket or plurality of pockets (one of which is designated 620), first, second and third fasteners and first logotype 641. While three fasteners are illustrated, fewer than three fasteners or no fasteners may also be used. Flexible wrapper 610 has inner face 611 and an outer face (see FIG. 7). Tool holder 600 is shown in FIG. 6 as it would appear laid open upon a horizontal surface. While not shown in order to enhance the clarity of other features in this embodiment, those skilled in the art will realize that a purse analogous to purse 143 of tool holder 100 illustrated in FIG. 1 may likewise be employed in this embodiment.

Flexible wrapper 610 is constructed of a sheet-like material, e.g. leather, vinyl, cloth, plastic, nylon, etc. and is preferably substantially rectangular in shape (although other shapes are well within the broad scope of the present invention). Flexible wrapper 610 has first and second parallel major edges 613 and 614, first and second parallel minor edges 116 and 117, and fold line (e.g. centerline) 615 between first and second major edges 613 and 614. While fold line 615 is illustrated and hereinafter described as a centerline between first and second major edges 613 and 614 those skilled in the art understand that it is not necessary to locate fold line 615 equidistant between the first and second major edges 613 and 614. It should also be understood that for the purposes of this discussion that the term fold line and centerline may be used interchangeably. First minor edge 616 has first notch 618*a* therein proximate corner 619 thereof and second notch 618*b* therein proximate fold line 615. First minor edge 616 also has indentation 616*a* formed therein from about first notch 618*a* to about second notch 618*b*.

First, second and third fasteners include first portions 631*a*, 632*a* and 633*a* and second portions 631*b*, 632*b* and 633*b* respectively. First portions 631*a*, 632*a* and 633*a* of the first, second and third fasteners are spaced apart and coupled to flexible wrapper 610 proximate first minor edge 616. Second portions 631*b*, 632*b* and 633*b* of first, second and third fasteners are spaced apart and coupled to flexible wrapper 610 proximate second minor edge 617. In a preferred embodiment, first portions 631*a*, 632*a* and 633*a* are male (stud) portions of a conventional snap fastener. The back side of first portions 631*a*, 632*a* and 633*a* are shown in FIG. 6. Similarly, second portions 631*b*, 632*b* and 633*b* include female (receiving) portions of the snap fasteners.

In an alternate embodiment, first portions, 631*a*, 632*b* and 633*a* may be hook portions of a Velcro fastener and second portions 631*b*, 632*b* and 633*b* may be pile portions of the Velcro fastener. Of course, the hook and pile portions may be interchanged while remaining within the scope of the present invention. Similarly, other types of fasteners, e.g., magnetic, clasps, buttons and button holes, ties, etc. may also be used. Those skilled in the art are familiar with the conventional methods used to couple such fasteners to flexible wrapper 610. In the embodiment where no fastener is used, the flexible wrapper can also include a tension loaded hinge. This hinge is located inside the flexible wrapper and is biased to allow the flexible wrapper to remain closed or opened. When flexible wrapper 610 is rolled up, first portions 631*a*, 632*a* and 633*a* and second portions 631*b*, 632*b* and 633*b* are configured to couple the first and second minor edges 616 and 617 together, wherein second minor edge 617 overlaps first minor edge 616.

Pockets 620 are affixed to inner face 611 by sewing or with a suitable adhesive. Pockets 620 have open end 623 aligned proximate fold line 615 and closed end 624 aligned proximate first major edge 614. Open end 623 of pockets 620 are configured to each receive at least a portion of tool 640. In a typical embodiment, pockets 620 comprise five pockets. However, those skilled in the art will realize that the number of pockets 620 may vary. Tool 640 may be virtually any tool, e.g. a screwdriver, a nutdriver, a wrench, a brush, a pair of pliers, a scraper, a knife, or a scalpel, etc. In a preferred embodiment, tools 640 are a variety of cosmetic brushes, artistic brushes or writing tools. Those skilled in the art will recognize that both cosmetologists and artists use a variety of brushes to accomplish their respective arts.

Figure 7:
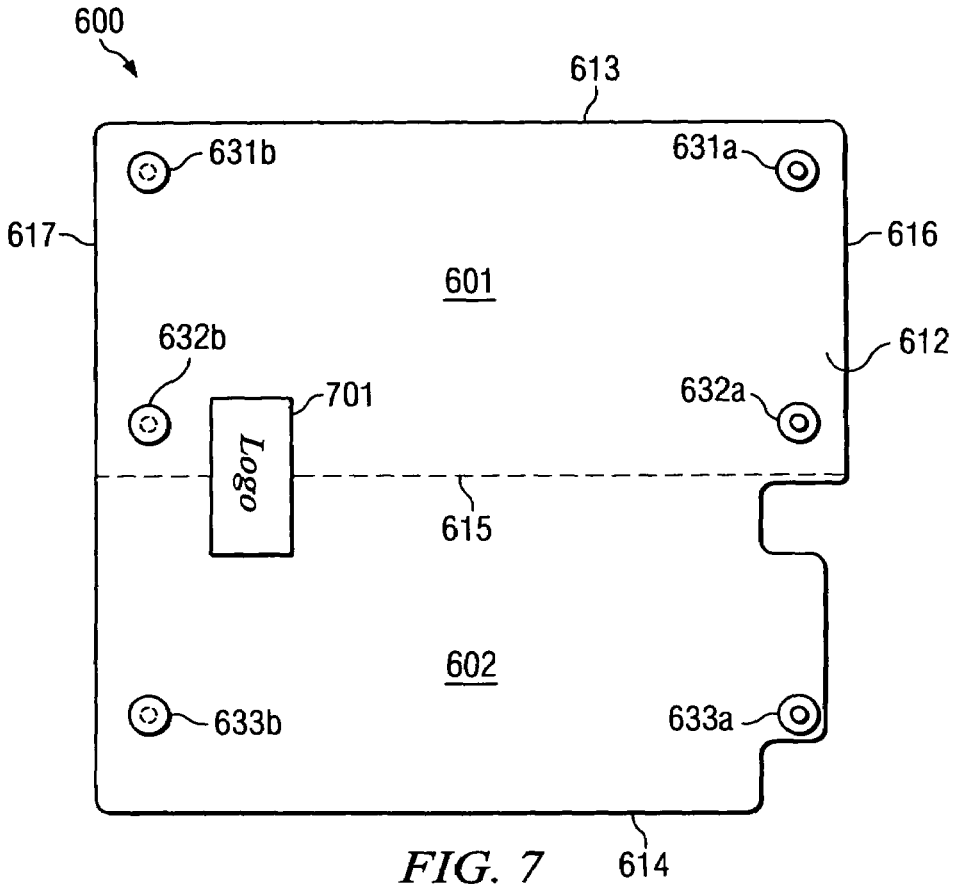
FIG. 7 illustrates a plan view of an outer face of the tool holder in FIG. 6.

Referring now to FIG. 7, illustrated is a plan view of outer face 612 of tool holder 600 of FIG. 6. Shown are the covers of second (e.g. female) portions 631*b*, 632*b* and 633*b* and first (e.g. male) portions 631*a*, 632*a* and 633*a* of first and third fasteners. Flexible wrapper 610 may further includes second logotype 701 to identify, for example, a manufacture of tool holder 600 or tools 640 contained therein. Second portions 631*b*, 632*b* and 633*b* and their respective first portions 631*a*, 632*a* and 633*a* are spaced apart along their respective minor edges 616 and 617 by substantially the same distances to further facilitate a coupling of first and second minor edges 616 and 617 when overlapped. Fold line 615 divides first section 601 from second section 602 and allows first section 601 from second section 602 and allows first section 601 to be folded over and in contact with second section 602.

Figure 8:
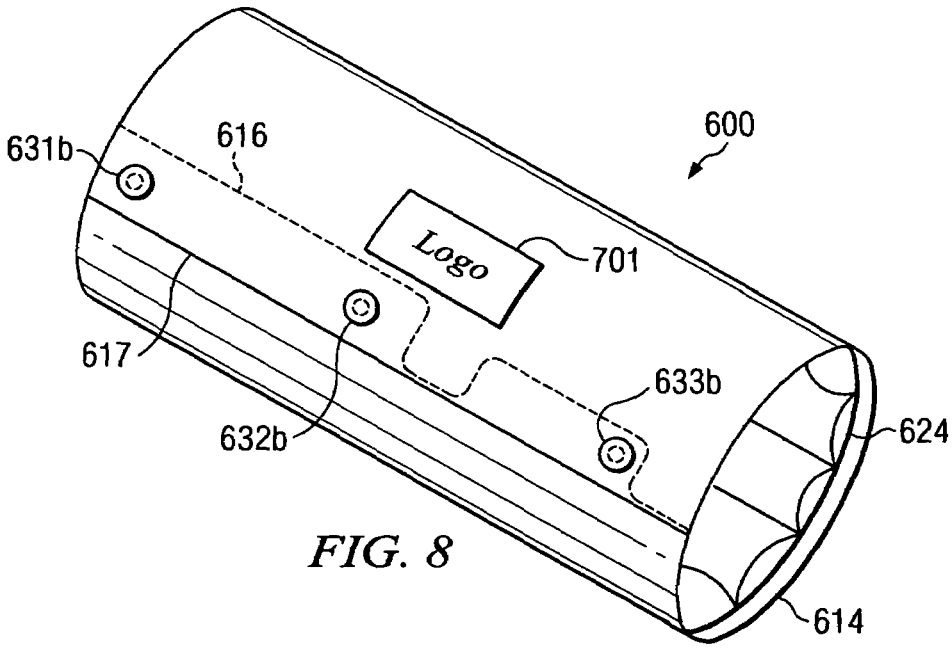
FIG. 8 illustrates an isometric view of the tool holder of FIG. 6 in a rolled, storage configuration.

Referring now to FIG. 8, illustrated is an isometric view of tool holder 600 of FIG. 6 in a rolled, storage configuration. Shown are the covers of second portions 631*b*, 632*b* and 633*b* of the first, second and third fasteners that couple first and second minor edges 616 and 617 together when overlapped. Second logotype 701 is visible in this configuration.

Figure 9:
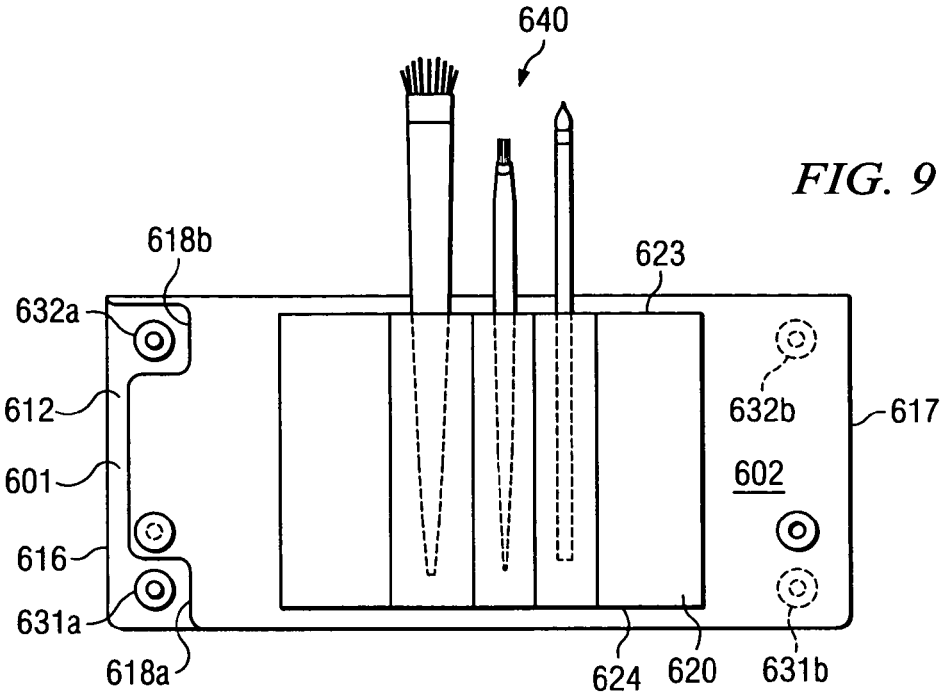
FIG. 9 illustrates a plan view of the tool holder of FIG. 6 with the outer face of a first section thereof folded over and in contact with the outer face of a second section thereof.

Referring now to FIG. 9, illustrated is a plan view of tool holder 600 of FIG. 6 with outer face 612 of first section 601 folded over and in contact with outer face 612 of the second section 602. First portions 631*a* and 632*a* of the first and second fasteners are shown to be in alignment with first notch 618*a* and second notch 618*b*, respectively. Pockets 620 with open end 623 and closed end 624 are clearly visible. Second portions 631*b* and 632*b* of the first and second fasteners are shown in phantom and aligned to couple to first portions 631*a* and 632*a* when tool holder 600 is rolled to couple first and second minor edges 616 and 617 together in an overlapped configuration. In the preferred embodiment shown, tools 640 are shown as they would appear having been inserted into open end 623 of pockets 620.

Figure 10:
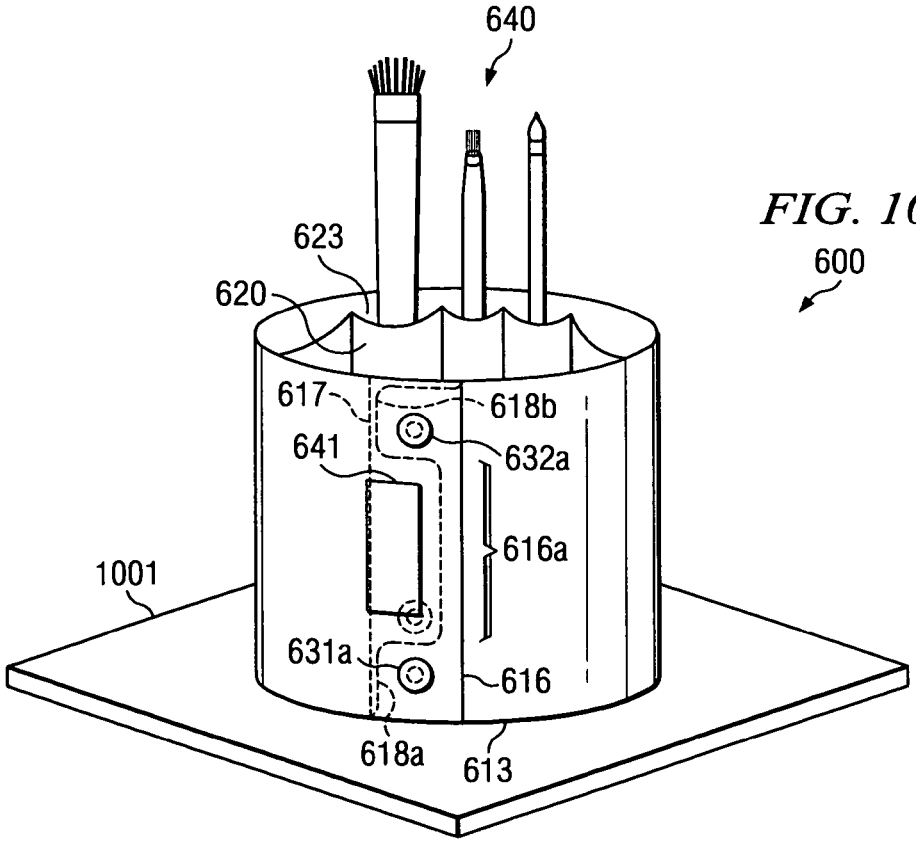
FIG. 10 illustrates an isometric view of the tool holder of FIG. 6 in a folded and free-standing, substantially circular display configuration.

Referring now to FIG. 10, illustrated is an isometric view of tool holder 600 of FIG. 6 in a folded free-standing, substantially circular display configuration. First major edge 613 is shown free standing upon surface 1001. It can be readily seen that the free-standing display of FIG. 10 consumes a significantly smaller amount of space than the unrolled holder of FIG. 6. The back side of first portions 631*a* and 632*a* of the first and second fasteners are shown as they couple first and second minor edges 616 and 617 together in an overlapped configuration. Indention 616*a* is configured so that first minor edge 616 in that area does not protrude from under the folded-over first minor edge 616 when tool holder 600 is in this configuration.

In an alternate embodiment of the freestanding display configuration, first and second minor edges 616 and 617 are coupled in an overlapped configuration so that the pockets 623 are on the exterior of the freestanding display. The first and second fasteners are used to couple the freestanding display in this configuration.

Furthermore, first notch 618*a* allows first and second portions 631*a* and 632*b* of the first fastener to align in opposition while the second fastener to align in opposition, so that first and second portions 631*a* and 631*b* of the first fastener and first and second portions 632*a* and 632*b* of the second fastener may be coupled. First logotype 641 is visible in this configuration. Shown are the tools 640 as they would appear extending from open end 623 of pockets 620.

In FIG. 6, the folded tool holder also comprises an elastic extension 650 and 660. Elastic extension 650 and 660 allow the diameter of the tool holder in a substantially cylindrical configuration to expand. In this embodiment, the tool holder can be wrapped around a person's arm.

Figure 11:
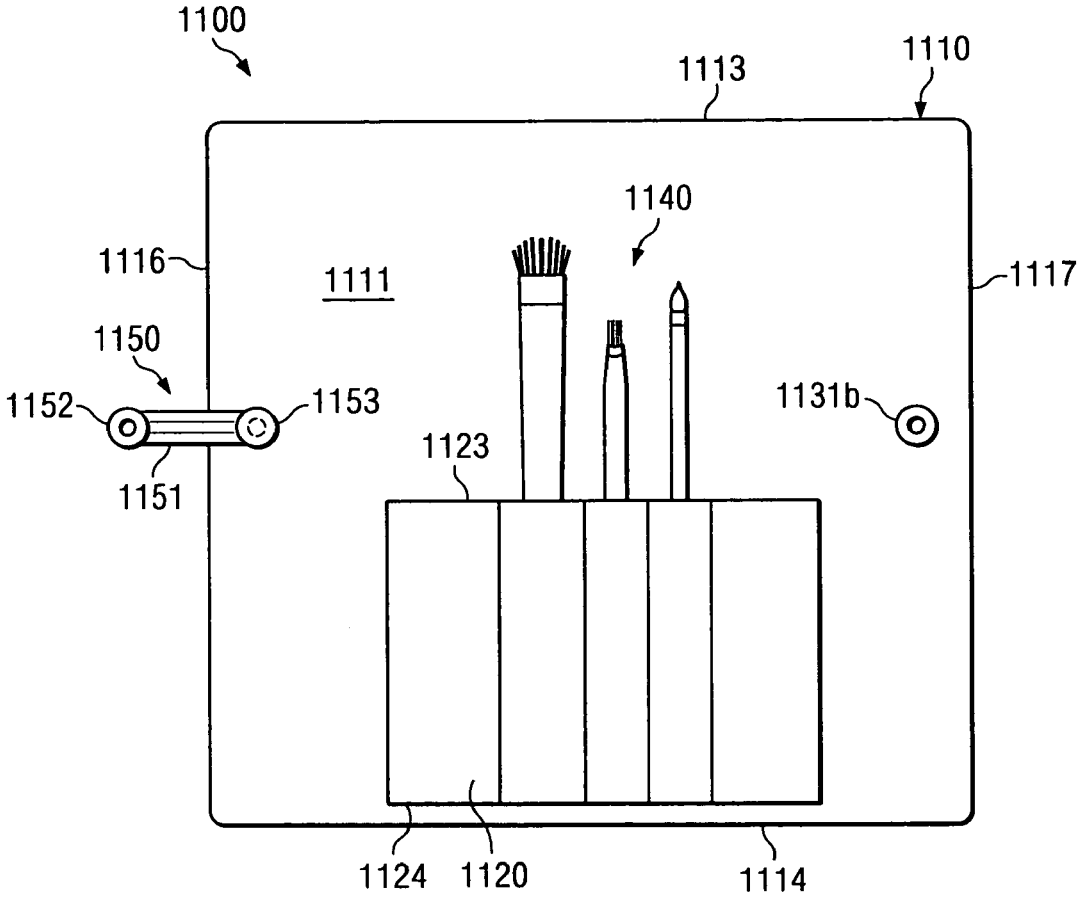
FIG. 11 illustrates a plan view of one embodiment of a tool holder constructed according to the principles of the present invention.
Figure 12:
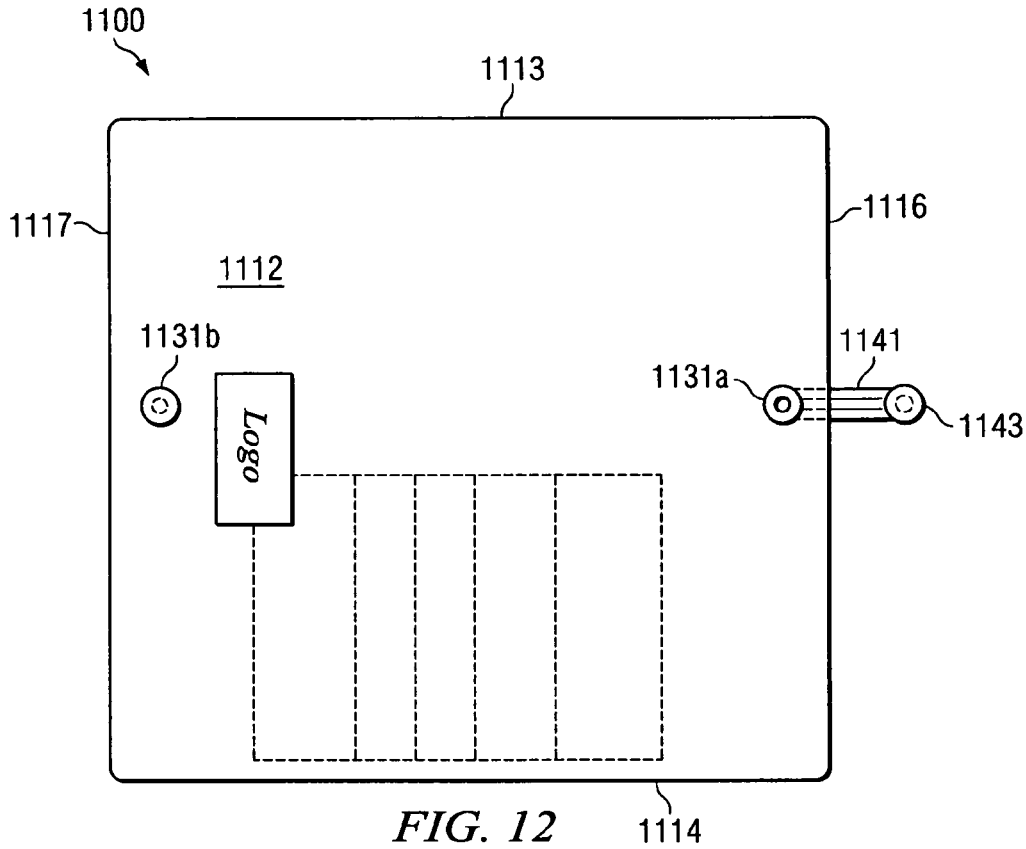
FIG. 12 illustrates a plan view of an outer face of the tool holder of FIG. 12.

Referring now to FIG. 11 and FIG. 12, illustrated is a plan view of one embodiment of tool holder 1100 constructed according to the principles of the present invention. Tool holder 1100 includes flexible wrapper 1110, pocket or plurality of pockets (one of which is designated 1120), and one fastener. One fastener is illustrated, but is not required. Flexible wrapper 1110 comprises inner face 1111 and outer 1112. Tool holder 1100 is shown in FIG. 11 as it would appear laid open upon a horizontal surface.

Flexible wrapper 1110 is constructed of a sheet-like material, e.g., leather, vinyl, cloth, plastic, nylon, etc., and is preferably substantially rectangular in shape. Other shapes may be used. Flexible wrapper 1110 has first and second parallel major edges 1113 and 1114, first and second parallel minor edges 1116 and 1117.

Fastener includes first portion 1131*a* and second portion 1131*b*. First portion 1131*a* of the fastener is spaced apart and coupled to flexible wrapper 1110 proximate first minor edge 1116. Second portion 1131*b* of the fastener is spaced apart and coupled to flexible wrapper 1110 proximate second minor edge 1117. In a preferred embodiment, first portions 1131*a* is a male (stud) portion of a conventional snap fastener wherein the stud portion extends from the outer face (see FIG. 12). The back side of first portions 1131*a* is shown in FIG. 11. Similarly, second portion 1131*b* includes a female (receiving) portion of the snap fastener with the receiving portion accessible on inner face 1111 of flexible wrapper 1110.

In an alternate embodiment, first portion 1131*a* may be hook portions of a Velcro fastener and second portion 1131*b* may be pile portions of the Velcro fastener. Of course, the hook and pile portions may be interchanged while remaining within the scope of the present invention. Similarly, other types of fasteners, e.g. magnetic, clasps, buttons and button holes, ties, etc. may also be used. Those skilled in the art are familiar with the conventional methods used to couple or mount such fasteners to flexible wrapper 1110. In another embodiment, no fastener is required. In the embodiment where no fastener is required, the flexible wrapper could also include a tension loaded hinge. The hinge is located inside the flexible wrapper and is biased to allow the flexible wrapper to remain closed or opened. When flexible wrapper 1110 is rolled up in a storage configuration, first portion 1131*a* and second portion 1131*b* are configured to couple first and second minor edges 1116 and 1117 together, wherein second minor edge 1117 overlaps first minor edge 1116.

Pockets 1120 are affixed to inner face 1111 by sewing or with a suitable adhesive or may be formed integrally with the wrapper surface or be heat molded in place. In a preferred embodiment, pockets 1120 may include a flexible, sheet-like material compatible with the sheet-like material of flexible wrapper 1110. Of course, other materials including a flexible mesh or transparent flexible material may also be used. Even a flexible, stretchable material may be used. Pockets 1120 are affixed to inner face 1111 of flexible wrapper 1110 by conventional means such as sewing, adhesive, etc. Those skilled in the art are familiar with methods of affixing one piece of flexible material to another piece of flexible material, whether they are similar or dissimilar.

The number and size of pockets 1120 are dictated by type and number of tools desired to be stored or displayed. Pockets 1120 have open ends (one of which is designated 1123) parallel to first minor edge 1113 and closed ends (one of which is designated 1124) aligned proximate second major edge 1114. For illustrative purposes, a variety of tools (one of which is designated 1140) are shown in conjunction with tool holder 1100. Open ends 1123 of pockets 1120 are configured to each receive at least a portion of each of tools 1140. Any number of pockets 1120 may be used.

Referring now to FIG. 12, illustrated is a plan view of outer face 1112 of tool holder 1100 of FIG. 11. Shown is the cover of second portion 1131*b* and first portion 1131*a* of the fastener. Flexible wrapper 1110 may further include logotype 1201 to identify, for example, a manufacturer of tool holder 1100 or the tools contained therein. Second portion 1131*b* and its respective first portion 1131*a* are spaced apart along their respective minor edges 1116 and 1117 by substantially the same distances to further facilitate a coupling of the first and second minor edges 1116 and 1117 when overlapped.

Figure 13:
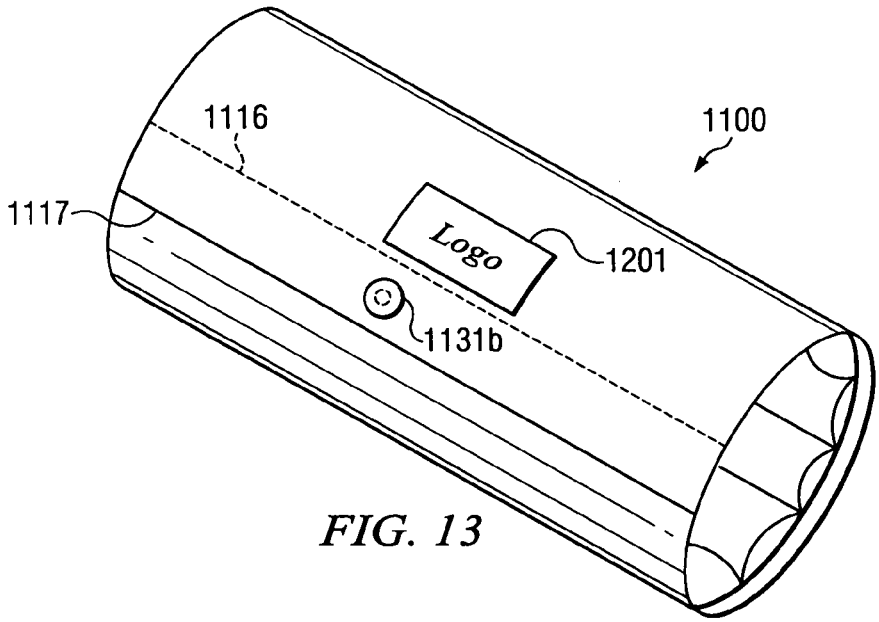
FIG. 13 illustrates an isometric view of the tool holder of FIG. 11 in a rolled, storage configuration.

Referring now to FIG. 13, illustrated is an isometric view of tool holder 1100 of FIG. 11 in a rolled, storage configuration. Shown is the cover of second portion 1131*b* of the fastener that couples first and second minor edges 1116 and 1117 together when overlapped. Logotype 1201 is visible in this configuration.

Figure 14:
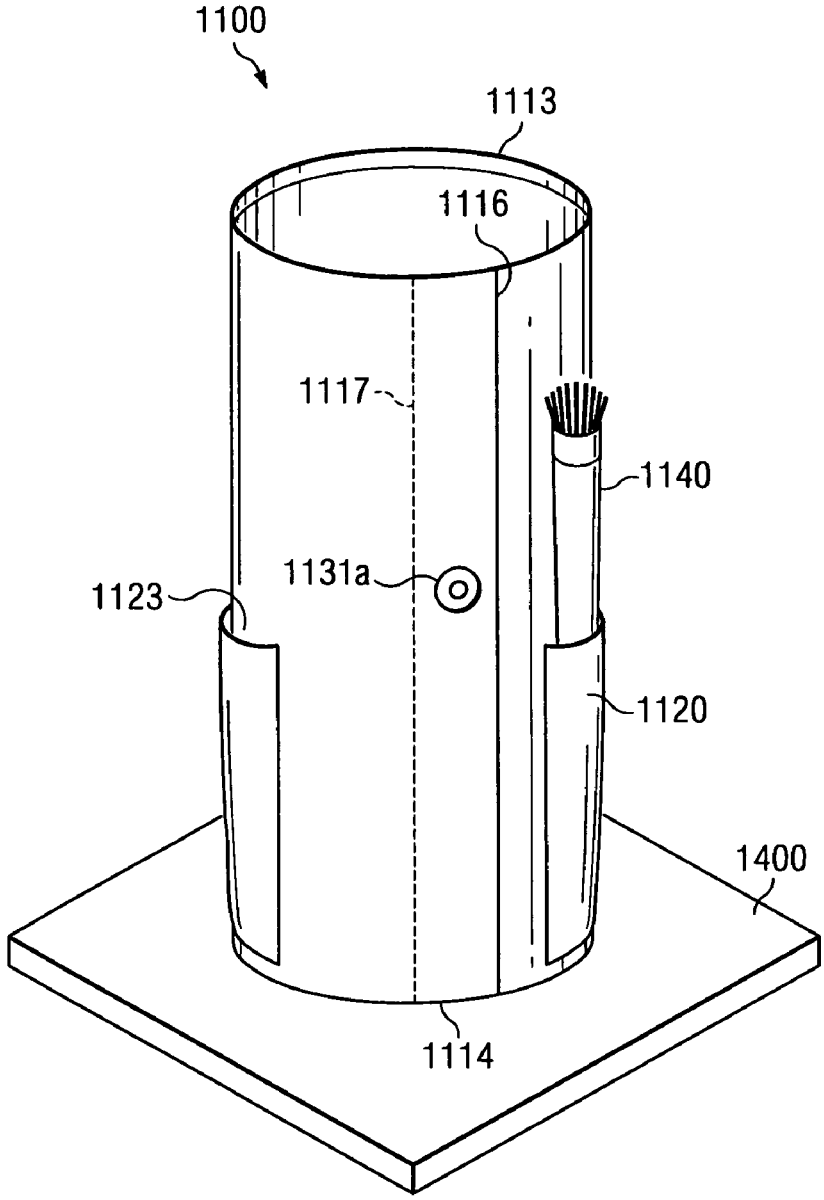
FIG. 14 illustrates an isometric view of the tool holder of FIG. 11 in a free-standing, substantially circular display configuration.

Referring now to FIG. 14, illustrated is an isometric view of tool holder 1100 of FIG. 11 in a free-standing, substantially circular configuration. To achieve this configuration, first minor edge 1116 is held adjacent to second minor edge 1117 by joining outer face 1112 to inner face 1111 by connecting the portions 1131*a* and 1131*b* of the fastener together. In the configuration shown, the pockets are on the outside of the freestanding display. In an alternate configuration not shown, the pockets may be on the inside of the freestanding display. Second major edge 1114 is shown free standing upon a surface 1400. Tools 1140 are shown as they would appear extending from open end 1123 of pockets 1120.

Figure 15:
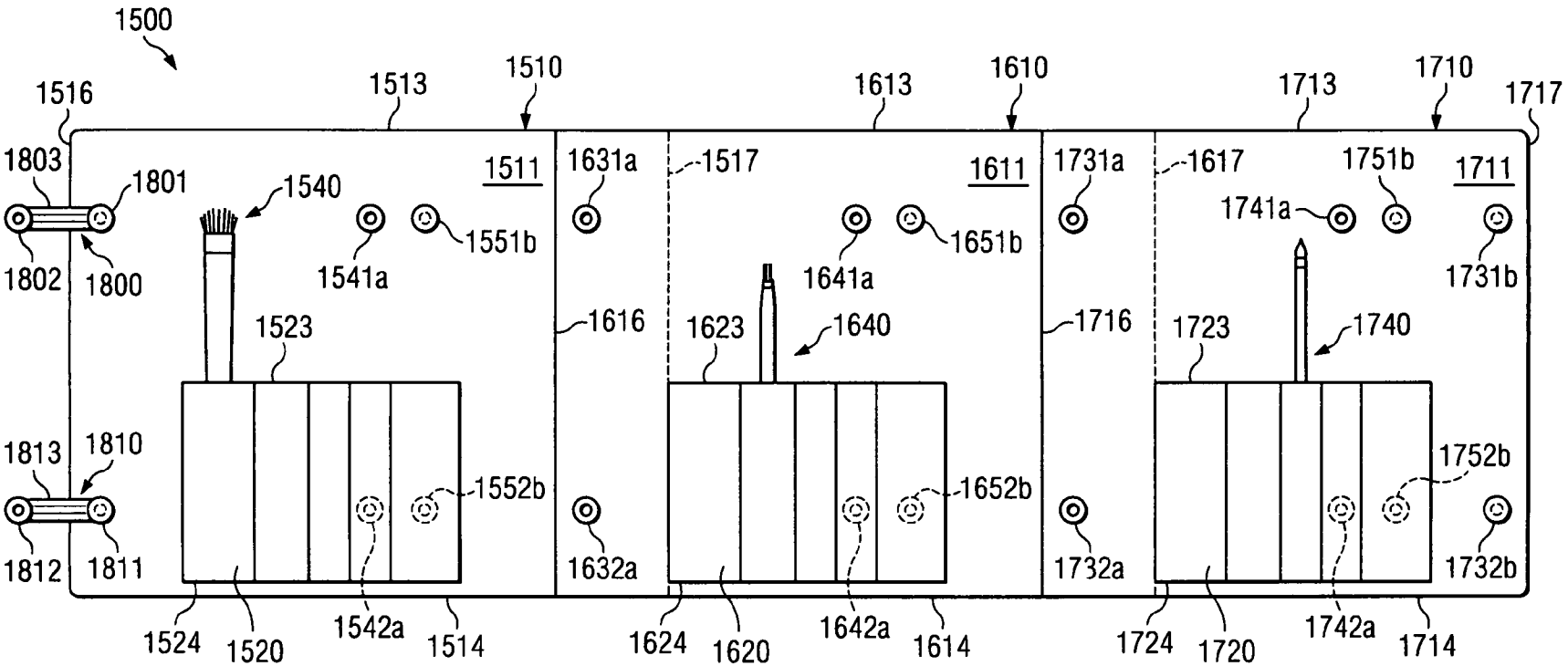
FIG. 15 illustrates a plan view of one embodiment of a tool holder constructed according to the principles of the present invention.
Figure 16:
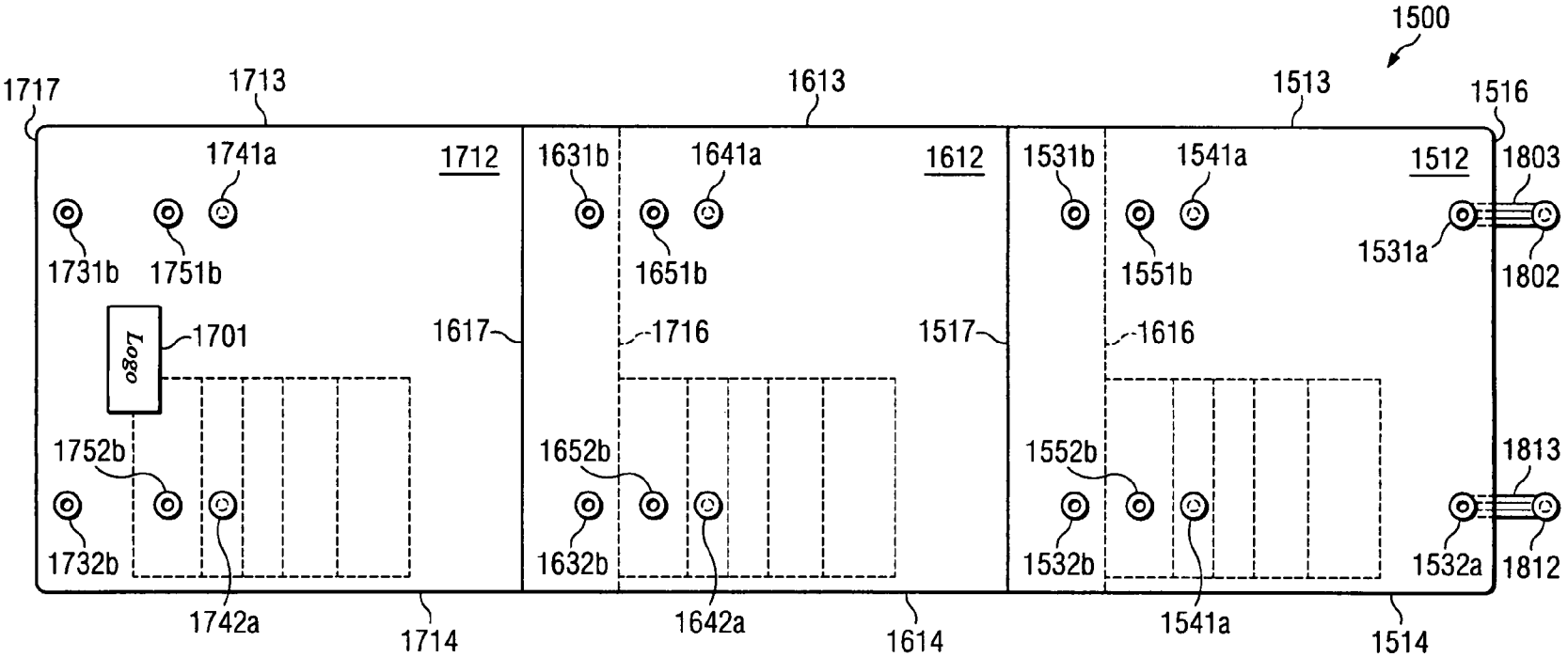
FIG. 16 illustrates a plan view of an outer face of the tool holder of FIG. 15.

Referring now to FIG. 15 and FIG. 16, illustrated is a plan view of one embodiment of tool holder 1500 constructed according to the principles of the present invention. Tool holder 1500 includes flexible wrappers 1510, 1610 and 1710. In this embodiment, flexible wrappers 1510, 1610 and 1710 are all identical, but this is not required. Three individual flexible wrappers are illustrated, but two or more flexible wrappers can be used.

Flexible wrappers 1510, 1610 and 1710 comprise a pocket or plurality of pockets (one of which is designated 1520, 1620, and 1720, respectively). Flexible wrappers 1510, 1610 and 1710 comprise inner face 1511, 1611 and 1711, respectively and outer faces 1512, 1612 and 1712, respectively. Tool holder 1500 is shown in FIG. 15 as it would appear laid open upon a horizontal surface.

Flexible wrappers 1510, 1610 and 1710 are constructed of a sheet-like material, e.g., leather, vinyl, cloth, plastic, nylon, etc., and is preferably substantially rectangular in shape. Other shapes may be used. Flexible wrappers 1510, 1610 and 1710 have first and second parallel major edges 1513 and 1514, 1613 and 1614 and 1713 and 1714 and first and second parallel minor edges 1516 and 1517, 1616 and 1617 and 1716 and 1717.

Each flexible wrapper further comprises eight fasteners. First, second, third and fourth fasteners on flexible wrappers 1510, 1610 and 1710 include fasteners 1531*a*, 1532*a*, 1541*a* and 1542*a*, 1631*a*, 1632*a*, 1641*a* and 1642*a* and 1731*a*, 1732*a*, 1741*a* and 1742*a*, respectively. First, second, third and fourth fasteners are considered an engaging group. Fifth, sixth, seventh and eight fasteners on flexible wrapper 1510, 1610 and 1710 include fasteners 1531*b*, 1532*b*, 1551*b* and 1552*b*, 1631*b*, 1632*b*, 1651*b* and 1652*b* and 1731*b*, 1732*b*, 1751*b* and 1752*b*, respectively. Fifth, sixth, seventh and eighth fasteners are considered an engaging group.

First, second, third and fourth fasteners 1531*a*, 1532*a*, 1541*a* and 1542*a*, 1631*a*, 1632*a*, 1641*a* and 1642*a* and 1731*a*, 1732*a*, 1741*a* and 1742*a* are spaced apart and fixed to flexible wrappers 1510, 1610 and 1710, respectively, proximate first minor edges 1516, 1616, and 1716. Fifth, sixth, seventh and eighth fasteners 1531*b*, 1532*b*, 1551*b* and 1552*b*, 1631*b*, 1632*b*, 1651*b* and 1652*b* and 1731*b*, 1732*b*, 1751*b* and 1752*b* are spaced apart and coupled to flexible wrappers 1510, 1610 and 1710, respectively, proximate second minor edge 1517, 1617 and 1717. In the preferred embodiment, the fasteners are mechanically secured to the wrapper by riveting. Other methods of mechanically securing the fasteners will also work.

In the preferred embodiment, first, second, third and fourth fasteners are male (stud) portions of a conventional snap wherein the stud portions extend from the outer faces. Similarly in this embodiment, fifth, sixth, seventh and eighth fasteners are female (receiving) portions of the snap fastener with the receiving portions accessible on inner faces. All that is imperative to this invention is that the first, second, third and fourth fasteners are opposite types of fasteners as the fifth, sixth, seventh and eighth fasteners.

In an alternate embodiment, first, second, third and fourth fasteners 1531*a*, 1532*a*, 1541*a* and 1542*a*, 1631*a*, 1632*a*, 1641*a* and 1642*a* and 1731*a*, 1732*a*, 1741*a* and 1742*a* may be hook portions of a Velcro fastener. While fifth, sixth, seventh and eighth fasteners 1531*b*, 1532*b*, 1551*b* and 1552*b*, 1631*b*, 1632*b*, 1651*b* and 1652*b* and 1731*b*, 1732*b*, 1751*b* and 1752*b*, may be pile portions of the Velcro fastener. Of course, the hook and pile portions may be interchanged while remaining within the scope of the present invention. Similarly, other types of fasteners, e.g. magnetic, clasps, buttons and button holes, ties, etc. may also be used. Those skilled in the art are familiar with the conventional methods used to couple or mount such fasteners to flexible wrappers 1510, 1610 and 1710.

Pockets 1520, 1620 and 1720 are affixed to inner faces 1511, 1611 and 1711, respectively by sewing or with a suitable adhesive or may be formed integrally with the wrapper surface or be heat molded in place. In a preferred embodiment, pockets 1520, 1620 and 1720 may include a flexible, sheet-like material compatible with the sheet-like material of flexible wrappers 1510, 1610 and 1710. Of course, other materials including a flexible mesh or transparent flexible material may also be used. Even a flexible, stretchable material may be used. Pockets 1520, 1620 and 1720 are affixed to inner faces 1511, 1611 and 1711of flexible wrappers 1510, 1610 and 1710 by conventional means such as sewing, adhesive, etc. Those skilled in the art are familiar with methods of affixing one piece of flexible material to another piece of flexible material, whether they are similar or dissimilar.

The number and size of pockets 1520, 1620 and 1720 is dictated by type and number of tools desired to be stored or displayed. Pockets 1520, 1620 and 1720 have open ends (one of which is designated 1523, 1623 and 1723) parallel to first minor edges 1513, 1613 and 1713, respectively, and closed ends (one of which is designated 1524, 1624 and 1724) aligned proximate second major edge 1514, 1614 and 1714, respectively. For illustrative purposes, a variety of tools (designated as 1540, 1640 and 1740) are shown in conjunction with tool holder 1500. Open ends 1523, 1623 and 1723 of pockets 1520, 1620 and 1720 are configured to each receive at least a portion of each of tools 1540, 1640 and 1740, respectively. Any number of pockets 1520, 1620 and 1720 may be used.

Flexible wrapper 1710 may further include logotype 1701 to identify, for example, a manufacturer of tool holder 1500 or the tools contained therein.

Figure 17:
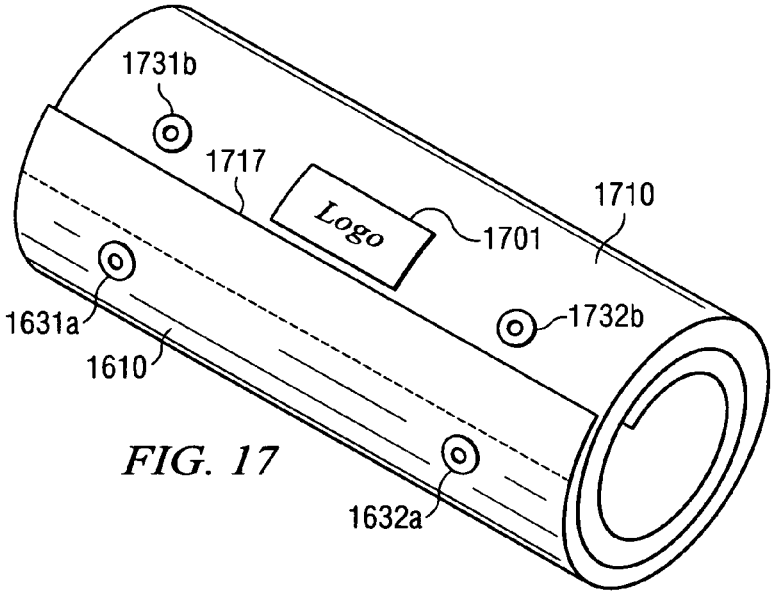
FIG. 17 illustrates an isometric view of the tool holder of FIG. 15 in a rolled, storage configuration.

As shown in FIG. 17, tool holder 1500 is in rolled into a storage configuration. In this configuration, fifth and sixth fasteners 1731*b* and 1732*b* and fourth and fifth fasteners 1641*a* and 1642*a* are arranged to couple first and flexible wrapper 1710 and 1610 together, so that second minor edge 1717 overlaps flexible wrapper 1610. Logotype 1701 is visible in this configuration. In alternate embodiments, when the tool holder is rolled into a storage configuration, it can have varying diameters. To facilitate the larger or smaller diameters of tools in the tool holder, the flexible wrappers are coupled together with the fasteners at the desired diameter.

Figure 18:
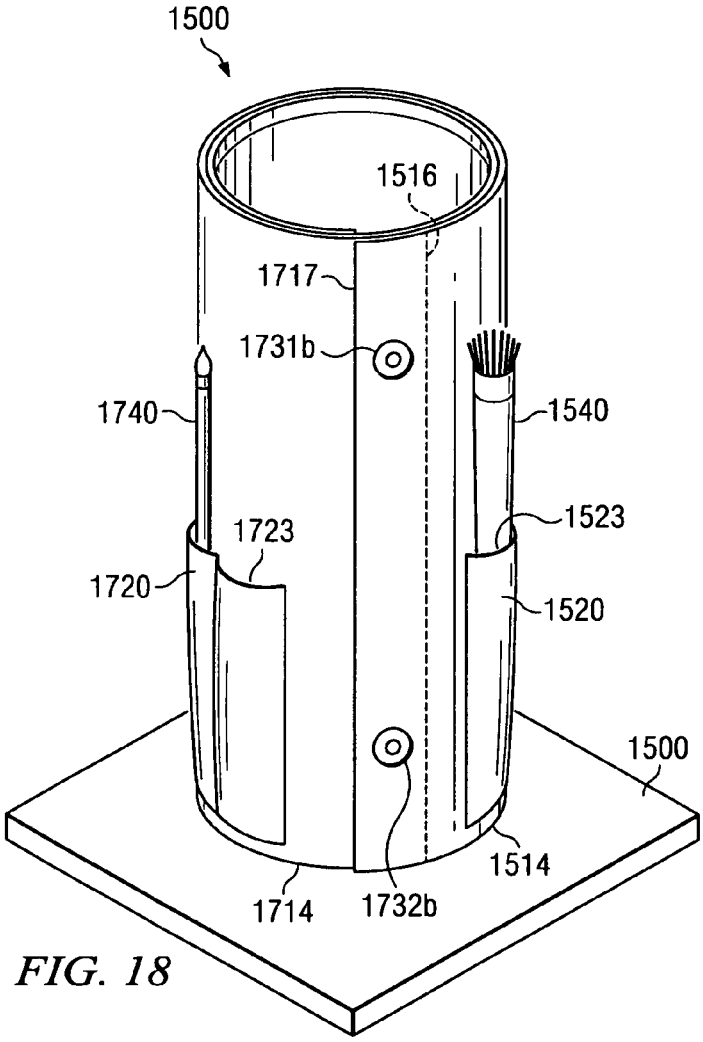
FIG. 18 illustrates an isometric view of the tool holder of FIG. 15 in a free-standing, substantially circular display configuration.

Referring now to FIG. 18, illustrated is an isometric view of tool holder 1500 in a free-standing, substantially circular configuration. First minor edge 1516 is held adjacent to second minor edge 1717 by joining outer face 1512 to inner face 1711 by connecting the first and second fasteners 1531*a* and 1532*a* to fifth and sixth fasteners 1731*b* and 1732*b*, respectively. In the configuration shown, the pockets are on the outside of the freestanding display. In a configuration not shown, the pockets may be on the inside of the freestanding display. Second major edges 1514, 1614 and 1714 of flexible wrappers 1510, 1610 and 1710, respectively, are shown free standing upon a surface 1500. Tools 1540 and 1740 extend from open end 1523 and 1723 of pockets 1520 and 1720.

In an alternate embodiment, the free standing substantially circular configuration of tool holder 1500 can have varying diameters. In these variable configurations, the flexible wrappers are indexed around each other and attached together via the fasteners at the desired diameter.

In FIGS. 15 and 16, the tool holder also comprises an elastic extension 1800 and 1810. Elastic extension 1800 and 1810 comprises a male fastener 1801 and 1811, respectively, and a female fastener 1802 and 1812, respectively, connected together by elastic, rubber or flexible plastic 1803 and 1813, respectively. Elastic extension 1800 and 1810 allow the diameter of the tool holder in a substantially cylindrical configuration to expand. In this embodiment, the tool holder can be wrapped around a user's arm in order to allow easy access to tools and pockets.

Thus, a tool holder has been described that provides a convenient roll-up storage configuration for many tools that protects the tools. The tool holder is convertible to a freestanding configuration that makes the same tools readily available for selection while occupying a significantly smaller footprint than when unrolled as a conventional tool holder would be.

Although the present invention has been described in detail, those skilled in the art should understand that they can make various changes, substitutions and alterations herein without departing from the spirit and scope of the invention in its broadest form.

The invention claimed is:

1. A tool holder comprising:

a first member including a first front side and a first back side having a first edge and a second edge and a first engaging group, a second engaging group and a first pocket all operably disposed on the first front side;

a second member including a second front side and a second back side having a third edge and a fourth edge and a third engaging group, a fourth engaging group and a second pocket all operably disposed on the second front side;

a flexible wrapper formed by engaging the second engaging group with the third engaging group;

a first configuration wherein the flexible wrapper is formed into a first cylinder with its axis generally parallel to all edges and the fourth engaging group is engaged to the first engaging group with the first pocket and the second pocket on the interior of the first cylinder; and a second configuration wherein the flexible wrapper is formed into a second cylinder with its axis generally parallel to all edges and the first engaging group is engaged to the fourth engaging group with the first pocket and the second pocket on the exterior of the second cylinder.

2. A tool holder comprising:

a first member including a first front side and a first back side having a first edge and a second edge and a first engaging group, a second engaging group and a first pocket all operably disposed on the first front side;

a second member including a second front side and a second back side having a third edge and a fourth edge and a third engaging group, a fourth engaging group and a second pocket all operably disposed on the second front side;

a flexible wrapper formed by engaging the second engaging group with the third engaging group;

a first configuration wherein the flexible wrapper is formed into a first cylinder with its axis generally parallel to all edges and the fourth engaging group is engaged to the first engaging group with the first pocket and the second pocket on the interior of the first cylinder;

a second configuration wherein the flexible wrapper is formed into a second cylinder with its axis generally parallel to all edges and the first engaging group is engaged to the fourth engaging group with the first pocket and the second pocket on the exterior of the second cylinder;

a third member including a third front side and a third back side having a fifth edge and a sixth edge and a fifth engaging group, a sixth engaging group and a third pocket all operably disposed on the third front side;

where the flexible wrapper further formed by engaging the fourth engaging group with the fifth engaging group;

a third configuration wherein the flexible wrapper is formed into a third cylinder with its axis generally parallel to all edges and the first engaging group is engaged to the sixth engaging group with the first pocket, the second pocket and the third pocket on the interior of the third cylinder; and a fourth configuration wherein the flexible wrapper is formed into a fourth cylinder with its axis generally parallel to all edges and the first engaging group is engaged to the sixth engaging group with the first pocket, the second pocket and the third pocket on the exterior of the fourth cylinder.

3. The tool holder of claim 2 further comprising a fifth configuration wherein the flexible wrapper is formed into a fifth cylinder with its axis generally parallel to all edges and the sixth engaging group is engaged to the third engaging group with the first pocket, the second pocket and the third pocket on the interior of the fifth cylinder.

4. The tool holder of claim 2 further comprising a sixth configuration wherein the flexible wrapper is formed into a sixth cylinder with its axis generally parallel to all edges and the third engaging group is engaged to the sixth engaging group with the second pocket and third pocket on the exterior of the sixth cylinder.

5. The tool holder of claim 2 wherein at least one engaging group comprises a plurality of fasteners.

6. The tool holder of claim 5 wherein fasteners are selected from the group consisting of: non-magnetic snap, magnetic snap, button and button hole, Velcro, and tie.

7. The tool holder of claim 2 wherein the first member, the second member and the third member are composed of material selected from the group consisting of: cloth, nylon, leather, vinyl and plastic.

8. The tool holder of claim 2 wherein the first pocket, the second pocket and the third pocket are configured to receive a tool.

9. The tool holder of claim 2 wherein the first member, the second member and the third member each further comprise an elastic type extension.

10. A method of creating a freestanding pocket display comprising:

providing a first member including a first front side and a first back side having a first edge and a second edge and a first engaging group, a second engaging group and a first pocket all operably disposed on the first front side;

providing a second member including a second front side and a second back side having a third edge and a fourth edge and a third engaging group, a fourth engaging group and a second pocket all operably disposed on the second front side;

forming a flexible wrapper by engaging the second engaging group with the third engaging group;

forming a first configuration wherein the flexible wrapper includes a first cylinder with its axis generally parallel to all edges and the fourth engaging group is engaged to the first engaging group with the first pocket and the second pocket on the interior of the first cylinder; and forming a second configuration wherein the flexible wrapper includes a second cylinder with its axis generally parallel to all edges and the first engaging group is engaged to the fourth engaging group with the first pocket or the second pocket on the exterior of the second cylinder.

11. A method of creating a freestanding pocket display comprising:

providing a first member including a first front side and a first back side having a first edge and a second edge and a first engaging group, a second engaging group and a first pocket all operably disposed on the first front side;

providing a second member including a second front side and a second back side having a third edge and a fourth edge and a third engaging group, a fourth engaging group and a second pocket all operably disposed on the second front side;

forming a flexible wrapper by engaging the second engaging group with the third engaging group;

forming a first configuration wherein the flexible wrapper includes a first cylinder with its axis generally parallel to all edges and the fourth engaging group is engaged to the first engaging group with the first pocket and the second pocket on the interior of the first cylinder;

forming a second configuration wherein the flexible wrapper includes a second cylinder with its axis generally parallel to all edges and the first engaging group is engaged to the fourth engaging group with the first pocket or the second pocket on the exterior of the second cylinder;

providing a third member including a third front side and a third back side having a fifth edge and a sixth edge and operably disposed on the third front side are a fifth engaging group, a sixth engaging group and a third;

where the step of forming a flexible wrapper further comprises the step of engaging the fourth engaging group with the fifth engaging group;

forming a third configuration wherein the flexible wrapper includes a third cylinder with its axis generally parallel to all edges and the first engaging group is engaged to the sixth engaging group with the first pocket, the second pocket and the third pocket on the interior of the third cylinder; and forming a fourth configuration wherein the flexible wrapper includes a fourth cylinder with its axis generally parallel to all edges and the first engaging group is engaged to the sixth engaging group the first pocket, the second pocket and the third pocket on the exterior of the fourth cylinder.

12. The method of creating a freestanding pocket display of claim 11 further comprising the steps of forming a fifth configuration wherein the flexible wrapper includes a fifth cylinder with its axis generally parallel to all edges and the sixth engaging group is engaged to the third engaging group with the first pocket, the second pocket and the third pocket on the interior of the fifth cylinder.

13. The method of creating a freestanding pocket display of claim 11 further comprising the steps of forming a sixth configuration wherein the flexible wrapper includes a sixth cylinder with its axis generally parallel to all edges and the third engaging group is engaged to the sixth engaging group with the second pocket and the third pocket on the exterior of the sixth cylinder.

14. The method of creating a freestanding pocket display of claim 11 further comprising the step of providing at least one engaging group further comprising a plurality of fasteners.

15. The method of creating a freestanding pocket display of claim 14 wherein fasteners are chosen from the group comprising: non-magnetic snap, magnetic snap, button and button hole, Velcro, and tie.

16. The method of creating a freestanding pocket display of claim 11 wherein the first member, the second member and the third member are composed of material chosen from the group comprising: cloth, nylon, leather, vinyl and plastic.

17. The method of creating a freestanding pocket display of claim 11 wherein the first pocket, the second pocket and the third pocket are configured to receive a tool.

* * * * *